US005433776A

United States Patent [19]

Dasgupta

[11] Patent Number: 5,433,776

[45] Date of Patent: Jul. 18, 1995

[54] STABLE BLEND OF KETENE DIMER SIZE AND COLLOIDAL SILICA

[75] Inventor: Sunil P. Dasgupta, Wilmington, Del.

[73] Assignee: Hercules Incorporated, Wilmington, Del.

[21] Appl. No.: 327,132

[22] Filed: Oct. 21, 1994

Related U.S. Application Data

[63] Continuation of Ser. No. 864,096, Apr. 6, 1992, abandoned.

[51] Int. Cl.[6] ..... C07D 493/00; D21H 21/16

[52] U.S. Cl. ..... 106/287.2; 106/287.17; 106/287.19; 162/158; 162/179; 162/181.6; 252/304; 252/313.1

[58] Field of Search ..... 106/266, 287.17, 287.19, 106/287.2; 162/158, 179, 181.6; 252/304, 313.1, 313.2

[56] References Cited

U.S. PATENT DOCUMENTS

| | | | |
|---|---|---|---|
| 2,627,477 | 2/1953 | Downey | 106/170 |
| 2,762,270 | 9/1956 | Keim et al. | 162/158 |
| 2,856,310 | 10/1958 | Weisberger | 106/287.24 |
| 2,865,743 | 12/1958 | Weisgerber | 162/181.6 |
| 2,961,367 | 11/1960 | Weisberger | 162/158 |
| 2,986,448 | 5/1961 | Gates et al. | 423/415.1 |
| 3,007,878 | 11/1961 | Alexander et al. | 252/313 |
| 3,130,118 | 4/1964 | Chapman | 162/175 |
| 3,620,978 | 11/1971 | Moore, Jr. | 252/313.2 |
| 3,719,607 | 3/1973 | Moore, Jr. | 252/313.2 |
| 3,922,243 | 11/1975 | Aldrich et al. | 524/602 |
| 3,923,745 | 12/1975 | Dumas | 162/169 |
| 3,956,171 | 5/1976 | Moore, Jr. et al. | 252/313.2 |
| 3,957,574 | 5/1976 | Anderson | 162/167 |
| 4,240,935 | 12/1980 | Dumas | 162/158 |
| 4,243,481 | 1/1981 | Dumas | 162/158 |
| 4,279,794 | 7/1981 | Dumas | 162/164 |
| 4,380,602 | 4/1983 | Dumas | 524/598 |
| 4,380,603 | 4/1983 | Bankert | 524/598 |
| 4,382,129 | 5/1983 | Bankert | 524/598 |
| 4,383,077 | 5/1983 | Bankert | 524/598 |
| 4,407,994 | 10/1983 | Bankert et al. | 524/107 |
| 4,861,376 | 8/1989 | Edwards et al. | 106/123.1 |
| 4,919,724 | 4/1990 | Cenisio et al. | 106/199 |

FOREIGN PATENT DOCUMENTS

| | | |
|---|---|---|
| 0261820 | 3/1988 | European Pat. Off. . |
| 0445953 | 11/1991 | European Pat. Off. . |
| 804504 | 11/1958 | United Kingdom . |

OTHER PUBLICATIONS

Ives, Kenneth, "The Scientific Basis Of Flocculation", pp. 3–7 (1978) [No Month].

Napper, Donald, "Polymeric Stabilization Of Colloidal Dispersions", pp. 1–17 (1983) [No Month].

*Primary Examiner*—Anthony Green

*Attorney, Agent, or Firm*—Ivan G. Szanto; Roy V. Jackson

[57] ABSTRACT

An improvement is disclosed in a method for sizing a paper product of sheeted cellulosic fibers by incorporating into the fibers a ketene dimer size, the improvement involving treating the fibers with an aquasol of positively charged colloidal silica, positively charged colloidal alumina, or positively charged colloidal zirconia containing the ketene dimer size.

10 Claims, No Drawings

STABLE BLEND OF KETENE DIMER SIZE AND COLLOIDAL SILICA

This application is a continuation of application Ser. No. 07/864,096, filed Apr. 6, 1992, now abandoned.

The present invention relates to sizing paper under alkaline papermaking conditions. In particular, it relates to using ketene dimer sizes under alkaline papermaking conditions.

Use of a ketene dimer as a sizing agent in papermaking is well known. Such agents are commonly used to size paper at alkaline pH. Ketene dimer sizes function by forming covalent bonds with cellulose to give proper orientation and anchoring of the hydrophobic chains. However, ketene dimer sizes have certain limitations, one of which is a tendency to contribute to paper slipperiness when added at high levels (greater than 0.15 weight %) internally or used as a surface size.

Since a ketene dimer and its hydrolysis product (stearone) are waxy solids, sizing with higher internal usage levels of alkyl ketene dimer or surface sizing therewith can reduce the coefficient of friction (COF), which would contribute to paper handling and converting problems. Such problems include telescoping of paper rolls during handling, as well as sliding of stacked, flattened cardboard boxes. A low COF can also cause potential conversion problems with fine paper grades, such as forms bond and reprographic.

To help control the COF of alkyl ketene dimer-sized paper, a solution of colloidal silica has been applied directly to the surface of paper sheets and boxes at the end of the manufacturing process. This requires an extra step in the papermaking process, thereby reducing efficiency and increasing costs.

In accordance with the present invention there is provided a composition comprising a stable aquasol of positively charged colloidal silica, positively charged colloidal alumina, or positively charged colloidal zirconia containing a ketene dimer size. The composition can be incorporated internally or applied as a surface size in a papermaking process and effects sizing while controlling the, COF. The present invention also provides an improvement in a method for sizing a paper product of sheeted cellulosic fibers comprising treating the fibers with a ketene dimer size, the improvement comprising treating the fibers with an aquasol of positively charged colloidal sil.ica, positively charged colloidal alumina, or positively charged colloidal zirconia particles containing the ketene dimer size. As noted above, the fibers can be treated by internal sizing, wherein the size is added to the paper pulp before sheet formation, or external sizing, wherein the size is applied to the surface of the formed paper sheet. Further, the present invention provides for a paper product comprising sheeted cellulosic fibers treated with the composition of the present invention.

Ketene dimer sizes useful in accordance with the present invention are reactive size materials that are well known. These compounds include both cationic, anionic, and non-ionic materials such as alkyl (including $C^{11-22}$) and cycloalkyl ketene dimers, aryl and aralkyl ketene dimers, and mixtures thereof. The present invention also contemplates the use of known stabilizers, such as cationic starch and cationic polymers, and other adjuvants in conjunction with the ketene dimer size. Exemplary ketene dimer sizes as well as stabilizers and other adjuvants are disclosed in U.S. Pat. Nos. 2,627,477, 2,762,270, 2,856,310, 2,961,367, 2,986,488, 3,130,118, 3,070,452, 3,957,574, 3,922,243, 3,923,745, 4,240,935, 4,407,994, 4,243,481, 4,279,794, 4,380,602, 4,380,603, 4,382,129, 4,383,077, 4,861,376, 4,919,724, and Canadian Pat. No. 1100265, the disclosures of which are incorporated herein by reference.

Stable aquasols of colloidal silica, alumina, and zirconia useful in accordance with the present invention are also well known. Typically, such sols start with colloidal, dense, finely divided particles, e.g., silica, generally having a surface area of about 20–600 square meters per gram, about 5–150 μm in diameter, that are generally stabilized with a small amount of an alkali, such as sodium hydroxide. Exemplary sols are those containing positively charged particles having a dense silica core coated with a polyvalent metal-oxygen compound along with an anionic counter-ion. These and other sols are well known as disclosed in U.S. Pat. Nos. 3,007,878, 3,620,978, 3,719,607, 3,745,126, and 3,956,171, the disclosures of which are incorporated herein by reference. Examples of stable aquasols of colloidal zirconia include zirconia-nitrate stabilized available under the name NYACOL Zr-50-20 from Nyacol Products Inc., Ashland, Mass. Examples of stable aquasols of colloidal alumina include a colloidal alumina dispersion available under the name NYACOL A1-20 from Nyacol Products Inc.

The amount of the ketene dimer applied to paper in accordance with the present invention will vary depending on the type of paper or pulp to be sized, ketene dimer size used, and amount of sizing desired. Preferably, the amount of ketene dimer applied either internally or as a surface size is about 0.01 to about 1.0 weight % based on the dry weight of fiber, more preferably about 0.05 to about 0.2 weight %. Stability criteria for the sol containing the ketene dimer size is that the viscosity value of the material is preferably less than 100 cps after four weeks at 32° C. The amount of silica used varies depending on the amount of ketene dimer employed. Preferably, up to 33 parts by weight of particulate silica per 100 parts by weight ketene dimer is contemplated.

Optionally, alum is included in the aquasol, preferably at higher levels of silica, in order to aid in stabilization. Preferably, the amount of alum varies from 0–2.5% by weight of the composition. As an alternative to alum, polyaluminum chloride can be used in similar amounts. Dispersions of negatively charged colloidal silica, such as available from Du Pont Company under the designations LUDOX HS-30 and HS-40, can also be mixed with the aquasol.

To more clearly describe the present invention, the following non-limiting examples are provided. In the examples all parts and percentages are by weight unless indicated otherwise.

EXAMPLES 1–4

Materials are prepared as follows. A stirred mixture in 92.17 parts water of 1.5 parts cationic starch having an ash content of 3–6%, maximum moisture of 12%, pH 3.5–5.5, 10% maximum common starch, 2.5% amylose maximum, maximum 5% eosin stain, 1.5% minimum protein, 0.24% minimum nitrogen, and viscosity (cold ratio 1–2.5, 190/75 ° C.) of 45–60. (available under the name AMAIZO 2187 from American Maize-Products Company, Hammond, Ind.) and 0.25 parts sodium lignin sulfonate dispersant (available from Ligno Tech, Greenwich, Conn. under the name LIGNISOL XD) is heated at about 95° C. for about 30 minutes at neutral pH. Water lost through evaporation is replaced, cooling the solution to about 65° C. To the mixture is added 6 parts of a mixed hexadecyl-hexadecanyl-ketene dimer size, prepared from a mixture of 45% stearic acid and 55% palmitic acid by forming the acid chlorides thereon and then reacting the acid chlorides with a tertiary amine, and 0.06 parts of a biocide (Biocide N521 available from Stauffer Chemical) and the mixture is blended until homogeneous. The resulting pre-mix is homogenized (about 211 kg/cm$^2$ at 65° C. with the collected homogenizate cooled to about 21° C. in a cold water bath). Alum (0.02 parts) is then added.

To the foregoing mixture, which is kept under stirring in a container at room temperature (about 25° C.), a cationic silica sol dispersion is slowly added. The cationic silica sols and their amounts are recorded in the following Table 1.

TABLE 1

| Ex. | silica sol | % amount[1] | Brookfield Viscosity (cps) As made | Brookfield Viscosity (cps) 4 weeks |
|---|---|---|---|---|
| 1 | sol #1[2] | 9.0 | 5 | 6 |
| 2 | sol #1 | 36 | 83 | 55 |
| 3 | sol #2[3] | 9.0 | 10 | 12 |

[1]Amount of sol based on the weight of the ketene dimer size.
[2]Cationic silica dispersion available from Nalco Chemical under the name NALCO-1SJ612.
[3]Cationic silica dispersion available from E. I. du Pont de Nemours & Co. under the name LUDOX CL.

I claim:

1. A composition comprising a stable aquasol of positively charged colloidal silica, positively charged colloidal alumina, or positively charged colloidal zirconia containing an emulsified alkyl ketene dimer size and a ketene dimer emulsifier.

2. The composition of claim 1, wherein the composition comprises a stable aquasol of positively charged colloidal silica containing the emulsified alkyl ketene dimer size.

3. The composition of claim 2, wherein the colloidal silica is coated with a polyvalent metal-oxygen compound.

4. The composition of claim 1, wherein the aquasol of positively charged colloidal silica, positively charged colloidal alumina, or positively charged colloidal zirconia containing the emulsified alkyl ketene dimer size further contains negatively charged colloidal silica.

5. The composition of claim 1, wherein the aquasol further contains alum.

6. The composition of claim 2, wherein the aquasol further contains alum.

7. A method for making the composition of claim 1 comprising the steps of forming an emulsion of alkylketene dimer in water containing an emulsifier and adding to the said emulsion a cationic aquasol of colloidal silica, colloidal alumina or colloidal zirconia.

8. The method of claim 7, wherein the cationic aquasol is an aquasol of colloidal silica.

9. The method of claim 7, in which the said emulsion is homogenized before the addition of the aquasol.

10. The method of claim 8, in which the said emulsion is homogenized before the addition of the aquasol.

* * * * *